United States Patent [19]

Delaplace

[11] Patent Number: 4,784,321

[45] Date of Patent: Nov. 15, 1988

[54] FLAME SPRAY TORCH FOR USE WITH SPRAY MATERIALS IN POWDER OR WIRE FORM

[75] Inventor: Philippe Delaplace, Chemin de Fontannaz, Switzerland

[73] Assignee: Castolin S.A., Saint-Sulpice, Switzerland

[21] Appl. No.: 9,362

[22] PCT Filed: Apr. 28, 1986

[86] PCT No.: PCT/CH86/00057

§ 371 Date: Dec. 23, 1986

§ 102(e) Date: Dec. 23, 1986

[87] PCT Pub. No.: WO86/06302

PCT Pub. Date: Nov. 6, 1986

[30] Foreign Application Priority Data

May 1, 1985 [CH] Switzerland ..... 1841/85

[51] Int. Cl.[4] ..... B05B 1/24

[52] U.S. Cl. ..... 239/83; 239/85; 239/390; 239/419.3; 239/424.5; 239/427; 239/600

[58] Field of Search ..... 239/79, 83, 84, 85, 239/390, 396, 419.3, 423, 424.5, 427, 600

[56] References Cited

U.S. PATENT DOCUMENTS

| | | | |
|---|---|---|---|
| 1,114,706 | 10/1914 | Brousseau | 239/419.3 |
| 2,544,259 | 3/1951 | Duccini et al. | 239/79 |
| 2,643,955 | 6/1953 | Powers et al. | 239/85 |
| 4,363,443 | 12/1982 | Huehne | 239/79 |
| 4,646,968 | 3/1987 | Sablatura et al. | 239/79 |

FOREIGN PATENT DOCUMENTS

| | | | |
|---|---|---|---|
| 1646027 | 7/1967 | Fed. Rep. of Germany . | |
| 499959 | 2/1920 | France | 239/423 |

*Primary Examiner*—Andres Kashnikow
*Assistant Examiner*—Michael J. Forman
*Attorney, Agent, or Firm*—Hopgood, Calimafde, Kalil, Blaustein & Judlowe

[57] ABSTRACT

A flame spray torch which comprises a torch body and a torch head exchangeably connected with each other. Injectors are inserted in recesses of the torch body partly projecting therefrom and extending into recesses of the torch head. Each injector communicates with a respective supply duct for combustion gas and oxidation gas, mixing chambers being provided respectively in each injector and in the torch head, the latter being provided with means to improve the gas mixing. The torque reduces the risk of back-firing and allows the attainment of optimum spraying conditions for a great variety of applications by permitting an easy exchange, particularly with respect to the injectors.

21 Claims, 2 Drawing Sheets

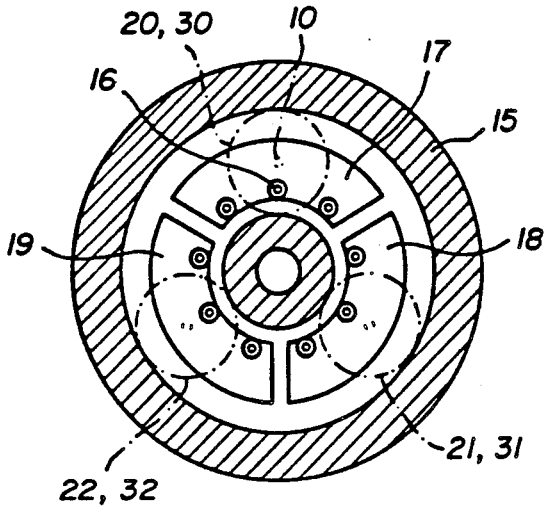
FIG. 3
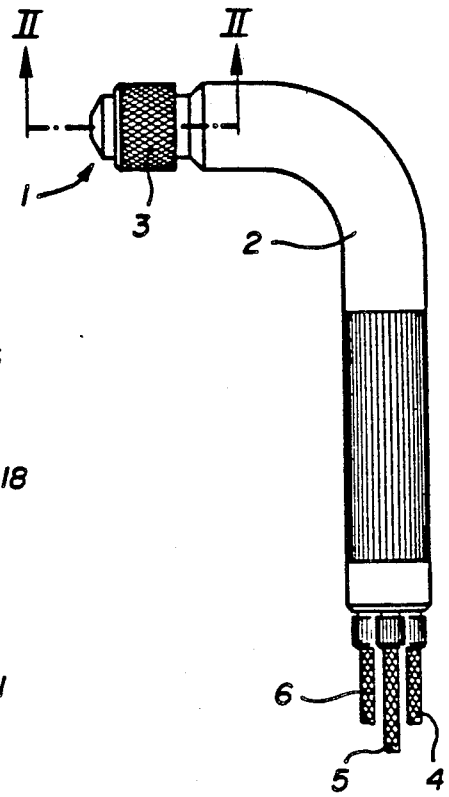
FIG. 1
FIG. 2
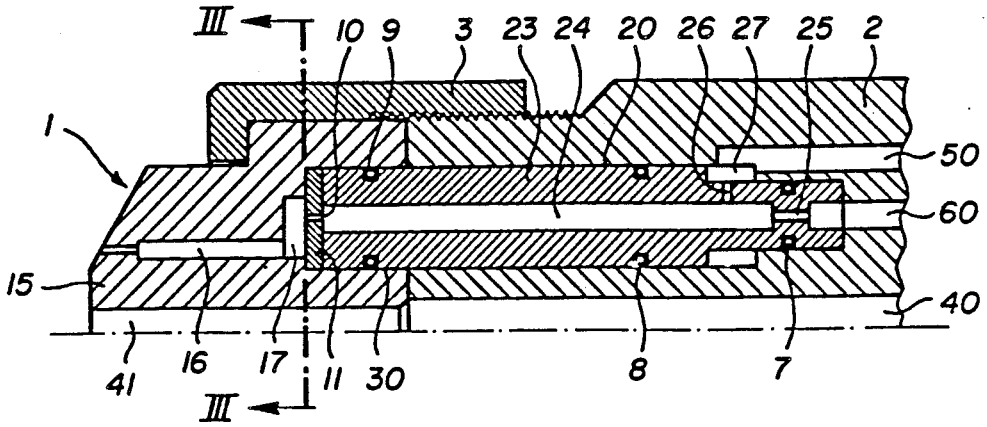

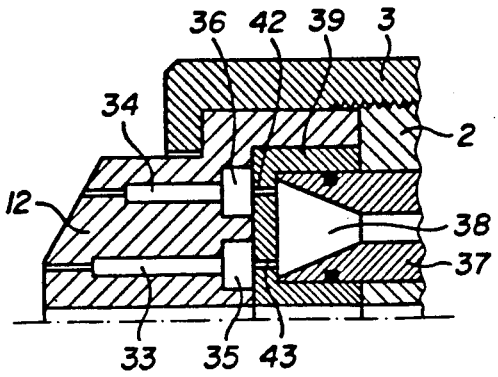
FIG. 4
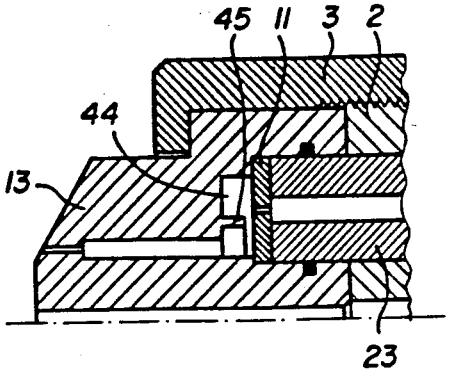
FIG. 5
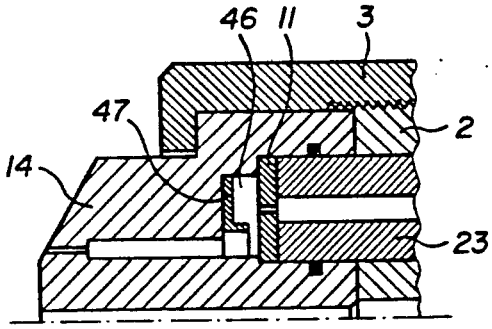
FIG. 6
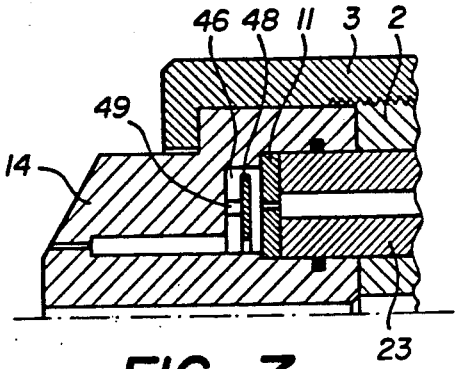
FIG. 7
FIG. 8
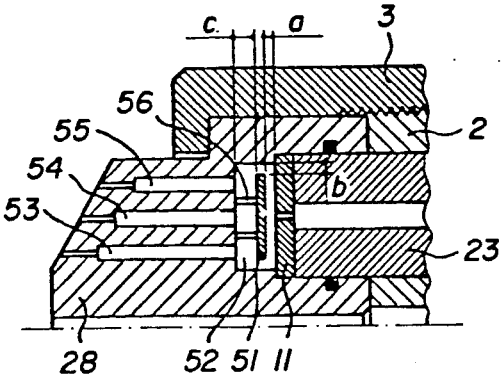
FIG. 9
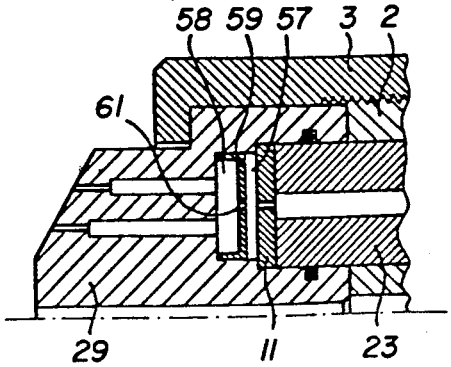

FLAME SPRAY TORCH FOR USE WITH SPRAY MATERIALS IN POWDER OR WIRE FORM

BACKGROUND OF THE INVENTION

The invention relates to a flame spray torch for use with spraying materials in powder or wire form, with a torch body and a torch head, the torch body having supply means for the spraying material as well as for a combustion gas and an oxidation gas and the torch head having a nozzle part provided with a plurality of gas nozzle channels and at least one channel for the spraying material, the nozzle part being exchangeably connected with the torch body.

DESCRIPTION OF THE PRIOR ART

Flame spray torches of this kind for spraying materials in powder form are known for example from the German Pat. No. 1 646 027. The arrangement described therein comprises an annular mixing chamber in the torch body to which on the one hand combustion gas is supplied from a common supply duct and in which end, on the other hand, are found several supply ducts for the oxidation gas. The mixing chamber has in this device a comparatively large volume due to which a return of the flame or a backfiring up to the mixing chamber may have very serious consequences, a flame return or backfiring being not entirely avoidable in such a torch as appeared in practice.

Furthermore, in such a known torch structure changing the flame energy is rather difficult and requires the assistance of a specialist to warant the required safety when exchanging the mixing device. This renders an adaptation to the use of spraying materials of different kinds rather problematic.

A further important disadvantage of such a torch consists in the fact that it cannot be adapted or that it is very difficult to adapt to the regulations existing in various countries with respect to the maximum admissible combustion gas pressure, since the necessary suction power in the injector requires a velocity of the oxidation gas which is already within the critical range.

Furthermore, in a torch of the known type the flame profile is predetermined as a whole and is not adaptable to individual application cases.

In order to reduce as much as possible the effects of a backfiring it has been proposed on the other hand to mix the gases only in the nozzle part. However, in such a torch the extent of mixing is not satisfactory since the gas path following the mixing is too short and since there is also no possibility to improve the extent of mixing by constructive means. It is therefore not possible to use the optimum flame velocity in such a torch and the irregularity of the individual flame cones affects the quality of the sprayed layers.

SUMMARY AND OBJECTS OF THE INVENTION

It is an object of the invention to eliminate the above-mentioned drawbacks of the known torches and to provide in particular a flame spray torch which can be adapted easily and without problem by the operator himself to the most different spraying conditions and application cases, in particular with regard to the torch power, thus allowing for reaching optimum spraying results and to warrant a substantially improved safety in operation.

According to the invention this is obtained by the fact that the torch body has longitudinal recesses which are accessible from the side where the connection with the nozzle part takes place for receiving at least two exchangeable combustion gas—oxidation gas—injectors, and for each injector a respective supply duct for the combustion gas and a respective supply duct for the oxidation gas which supply ducts communicate with the corresponding inlet ducts of the injector.

Preferably, the injectors inserted in the recesses of the torch body project in part out of the torch body and the nozzle part has on its side recesses for receiving the injector portions which project from the torch body.

BRIEF DESCRIPTION OF THE DRAWINGS

FIG. 1: A general view of a flame spray torch according to the invention;

FIG. 2: A half axial section of the front part of the torch body and of the nozzle part of the flame spray torch of FIG. 1;

FIG. 3: A section along line III—III of FIG. 2;

FIG. 4: A part axial section of a torch head according to a modified embodiment;

FIG. 5: An axial section of a nozzle part according to a further embodiment, and FIGS. 6 to 8: Further embodiments of a nozzle part for a flame spray torch according to the invention.

FIG. 9: a partial axial directional view of another embodiment of the invention wherein the mixing chamber is divided into two adjacent partial chambers.

DESCRIPTION OF THE PREFERRED EMBODIMENTS

The torch according to FIGS. 1 to 3 is an autogenous powder flame spray torch with a torch head 1 mounted on a torch body 2 by means of a cap screw 3. The torch body is supplied with a mixture of flame spray powder and a carrier gas, for example, oxygen or air for carrying the powder, for example over a connection conduit 4, as well as with acetylene as combustion gas and oxygen as oxidation gas, over respective connection conduits 5 and 6. The torch body may comprise further means not represented, for the connecting, adjusting and shutting-off of these gases and of the spray powder.

According to FIG. 2 the torch head 1 comprises essentially a nozzle part 15. The torch body 2 has in the present example a central feeding channel 40 the extension of which is a channel 41 of the nozzle part. Furthermore the torch body has three longitudinal cylindrical recesses 20, 21, 22, the locations of which are indicated in interrupted lines in FIG. 3. In each of these recesses which are open towards the nozzle part 15, corresponding combustion gas—oxidation gas—injectors are exchangeably lodged such as the injector indicated by 23 in FIG. 2.

Such an injector comprises a central mixing channel 24 in which end, on the one hand, in a longitudinal direction, an injector channel 25 and, one the other hand, in the radial direction, a suction channel 26. As shown in FIG. 2, the cross sections of these inlet channels 25, 26 of the injector are substantially smaller than the cross section of the mixing channel.

The suction channel 26 communicates with a combustion gas supply channel 50 which extends in the longitudinal direction, in fact through an annular feeding chamber 27 which is formed by a recess left between the injector body 23 and the torch body 2 and which makes the inserting of a cylindrical injector such as the one here, independent of the angular position of the same.

The oxidation gas inlet channel 25 is an extension, preferably in the longitudinal direction of a supply channel 60.

At the end of the injector 23 opposite to the gas supply the body of the injector projects from the torch body and is received in a corresponding recess 30 of the nozzle part. The wall parts of the injector body between the two inlet channels as well as before and behind the connecting surface between the nozzle part and the torch body are tightly connected with the wall surfaces of the corresponding recesses by means of elastic sealing rings 7, 8, 9. In FIG. 3 the recess 30 as well as recesses 31 and 32 opposite the recesses in the torch body 21 and 22 are indicated by interrupted lines.

In the nozzle part of the present embodiment a plurality of gas channels 16, here three, communicate with a corresponding common gas mixing chamber such as 17, 18, 19. Each of these gas mixing chambers has an inlet opening which is formed for example by a connecting channel 10 and communicates with the outlet opening of the injector. The communicating channel can be formed by a bore in an intermediate part 11 arranged in the recess 30 contiguously to the injector body. The cross-section of the inlet opening of the gas mixing chamber is made smaller than the cross-section of the outlet opening of the injector and substantially smaller than the cross section of the gas mixing chamber itself.

As a result of from the arrangements described above, the total volume of combustion gas and oxidation gas as supplied is distributed according to the invention between a plurality of mutually independent injector mixing devices. In each of these mixing devices the cross-section of the injector channel, in particular, is adapted in accordance with the given combustion gas pressure, so that it becomes possible, in an uncritical manner, to obtain a sufficient suction power for the desired mixture even at comparatively low combustion gas pressure, by increasing the velocity of the oxidation gas.

The other dimensions of an injector are also adapted in an optimum manner with respect to each other in each particular case. The distribution of the mixing volumes among a plurality of independent injectors offers a decisive advantage in the dimensioning of the injectors in particular as far as the injector channel is concerned, since the conditions thereby become less critical as well in mechanical respect as regarding the flow configuration. Furthermore, even in the event of a flame return in one of the gas pathes, the effect of such a flame return or of a back-firing is limited to the corresponding partial volume so that the corresponding risk is substantially reduced not only in its frequency but also as to its extent.

The mixing of the gases by means of a plurality of independent injector arrangements proves to be substantially better in this connection as compared to that of a usual bigger mixing chamber supplied from a single combustion gas channel. The mixing is furthermore increased in the present torch by means of constructive measures at the level of the nozzle part, for example by the already mentioned mixing chamber 17.

Furthermore the arrangement of a plurality of independent individually exchangeable injector devices allows first for choosing the injectors in accordance with the desired torch power and secondly for inserting also different injectors in the individual recesses so as to form a flame profile over the whole periphery of the nozzle part in a variable manner and adapted to a given case of use. In addition, it provides the possibility for varying the attribution of an individual gas nozzle to a given injector to an extremely large extent by the use of different nozzle parts having each different arrangements of the nozzle channels and of the mixing chambers. For example, in the above described torch a nozzle part can be used in which the mixing chambers 17, 18, 19 are either united in a single annular chamber or are formed such that any desired connection of the individual nozzle channels 16 with the recesses 20, 21 and 22 can be obtained. These injectors can have a different capacity as already mentioned and can even be realized as a closing member namely as a tight closure of the corresponding gas supply channels 50, 60, thus allowing to obtain a particularly strong asymmetry of the flame profile.

The structure described here in which the injectors project from the torch body allows a particularly easy exchange of the injectors by hand without special tools. In this connection the sealing means are also of importance, elastic sealing rings being preferably provided between the injector body and the torch body on the one hand and the nozzle part on the other hand. Furthermore, it is to be noted that the nozzle part itself can have a very simple structure and thus the cost of an exchange of this part which is subject to wear can be kept low.

FIGS. 4 to 9 show various other embodiments of the torch head, in which similar parts as in the preceding figures are designated by the same respective reference numerals.

FIG. 4 shows a nozzle part 12 in which nozzle channels 33, 34 are arranged at different radial distances. The individual nozzle channels are again communicating with mixing chambers such as 35, 36, the shape of these mixing chambers and the arrangement of the inlet openings being chosen such that, except for constructive limitations, any desired gas nozzle channel can be supplied from a given injector. The embodiment of FIG. 4 comprises an injector 37 the opening end 38 of which is conically enlarged and extends into an intermediate part 39 having two connecting channels 42, 43. The resulting expansion of the gas mixture at the mouth end and the following acceleration in the channels 42, 43 already produces a good mixing at this point which is followed by a further mixing in the chambers 35 and 36, respectively.

FIG. 5 shows a nozzle part 13 which is similar to that shown in FIG. 2, but in which the mixing chamber 44 has a projection 45 which divides this mixing chamber in two partial chambers which communicate with each other through a restriction, whereby a further improvement of the mixing is obtained.

FIG. 6 shows an embodiment of a nozzle part 14 in which the division of the mixing chamber, here 46, into two partial chambers is realized by means of an insert part 47 which is adapted in the recess forming the mixing chamber. This can be advantageous inter alia for manufacturing reasons.

FIG. 7 shows an arrangement in which the mixing chamber 46 of the nozzle part comprises a movable insert part 48 which is, for example, formed as a thin disk and which is kept at a distance from the back wall of the mixing chamber at the outlet end thereof by means of a spacing member 49. The forced deviation of the gases provides an even better mixing of the same before the entering thereof into the nozzle channel.

FIG. 8 shows also an embodiment of a nozzle part, here 28, with a movable insert part 51 in a mixing chamber 52 which communicates for example in the plane of the section with three nozzle channels 53, 54, 55. Spacing members 56 are again used to keep a minimum distance between the insert part and the outlet openings of the mixing chamber. The distances of the insert part from the walls have been designated in FIG. 8 by "a", "b" and "c" and to obtain an optimal mixing they have the following values:

a: Between 0.05 and 0.5 mm, b: Between 0.1 and 3 mm, c: Between 0.2 and 10 mm, preferably between 0.5 and 8 or between 1 and 7 mm.

The arrangement is specifically chosen so that distance a is smaller than b and distance b is smaller than c. As spacing members 56 one can in particular use pins which are fixed either with the wall of the mixing chamber or with the insert part.

FIG. 9 shows another form of the division of the mixing chamber into two adjacent partial chambers 57 and 58. Both mixing chambers are separated from each other by means of an insert part 59 inside a common recess of the nozzle part 29 and communicate over one or more bores such as 61. The cross-section of the second gas mixing chamber 58 is in that case substantially larger than that of the communication channel or the totality of the communication channels 61 and of course also larger than that of the totality of the outlet openings of this mixing chamber.

Modifications of the herein described embodiments are within the reach of a person skilled in the art and allow an optimal adapting of the torch to the most different application cases within the framework of the basic arrangement according to the invention.

This applies as well to the shown example of a powder flame spray torch as well as to a torch for wire-shaped spraying materials which are well known per se and in which a spraying wire is advanced for example through channels such as 40, 41 in FIG. 2 and the nozzle part has additional nozzles generally supplied with air.

I claim:

1. A flame spray torch for use with powdered or wire-shaped spraying materials with a torch body and a torch head, the torch body having feeding means for the spraying material as well as for a combustion gas and an oxidation gas and the torch head having a nozzle part provided with a plurality of gas nozzle channels and at least one channel for the spraying material, said torch having means for exchangeably connecting said nozzle part with said torch body along a contact surface, said nozzle part and said torch body being arranged so that said channel for the spraying material in the nozzle part communicates with said spraying material feeding means of the torch body, said torch body having at least two longitudinal recesses open towards said contact surface for receiving at least two exchangeable combustion gas—oxidation gas—injectors, said torch body further having for each injector an individual combustion gas supply channel and individual oxidation gas supply channel which supply channels are arranged for communicating with corresponding inlet channels of each injector, each injector having a mixing chamber communicating with said inlet channels and having an outlet channel arranged for communicating with at least one gas nozzle channel of said nozzle part.

2. A flame spray torch as claimed in claim 1, wherein said nozzle part has at least a first gas mixing chamber which communicates through at least one inlet opening, with said outlet channel of at least one injector and, through at least one outlet opening, with at least one gas nozzle channel, the cross-section of said inlet opening being smaller than the cross-section of said outlet channel of the injector and substantially smaller than the cross-section of said first gas mixing chamber.

3. A flame spray torch as claimed in claim 2, wherein said injector outlet channels have an end portion, the cross-section area of which is increasing towards said nozzle part.

4. A flame spray torch as claimed in claim 2, wherein said first gas mixing chamber has a restricted portion between said inlet and outlet openings thereof.

5. A flame spray torch as claimed in claim 2, wherein said first gas mixing chamber contains a movably arranged insert post between said inlet and outlet openings thereof.

6. A flame spray torch as claimed in claim 5, wherein said insert part in the gas mixing chamber is arranged so that its distance from the inlet opening of the chamber is always smaller than its distance from the outlet opening of the chamber.

7. A flame spray torch as claimed in claim 6, wherein the distance between said insert part and a wall portion of the gas mixing chamber surrounding the opening is between 0.05 and 0.5 mm.

8. A flame spray torch as claimed in claim 7 wherein the distance between said insert part and a wall portion of the gas mixing chamber surrounding the outlet opening thereof is between 0.2 and 10 mm, between 1 and 7 mm.

9. A flame spray torch as claimed in claim 7 wherein the distance between said insert part and a wall portion of the gas mixing chamber surrounding the outlet opening thereof is between 0.5 and 8 mm.

10. A flame spray torch as claimed in claim 7 wherein the distance between said insert part and a wall portion of the gas mixing chamber surrounding the outlet opening thereof is between 1 and 7 mm.

11. A flame spray torch as claimed in claim 6 wherein the distance between said insert part and a wall portion of the gas mixing chamber surrounding the outlet opening thereof is between 0.2 and 10 mm, between 1 and 7 mm.

12. A flame spray torch as claimed in claim 6 wherein the distance between said insert part and a wall portion of the gas mixing chamber surrounding the outlet opening thereof is between 0.5 and 8 mm.

13. A flame spray torch as claimed in claim 6 wherein the distance between said insert part and a wall portion of the gas mixing chamber surrounding the outlet opening thereof is between 1 and 7 mm.

14. A flame spray torch as claimed in claim 2 wherein said insert part has the shape of a plate and is provided with spacing means to keep a minimum distance at least from a wall portion of the mixing chamber surrounding the outlet opening thereof.

15. A flame spray torch as claimed in claim 2 wherein said nozzle part has at least a gas mixing chamber which communicates with at least one first gas mixing chamber over a connecting channel, the cross-section of said second gas mixing chamber being larger than that of said connecting channel, said second gas mixing chamber communicating with at least one gas nozzle channel.

16. A flame spray torch as claimed in claim 15 wherein said nozzle part has at least a gas mixing chamber which communicates with at least one first gas mixing chamber over a connecting channel, the cross section of said second gas mixing chamber being larger than that of said connecting channel, said second gas mixing chamber communicating with at least one gas nozzle channel.

17. A flame spray torch as claimed in claim 2 wherein a first gas mixing chamber communicates with at least two second gas mixing chambers which communicate themselves with separate gas nozzle channels.

18. A flame spray torch as claimed in claim 2 comprising at least two first gas mixing chambers.

19. A flame spray torch as claimed in claim 18 wherein each gas mixing chamber communicates with at least two gas nozzle channels.

20. A flame spray torch as claimed in claim 2 wherein each gas mixing chamber communicates with at least two gas nozzle channels.

21. A flame spray torch as claimed in claim 1 wherein the injectors inserted in the recesses of the torch body partly project from the torch body and wherein the nozzle part has recesses for receiving the injector parts projecting from the torch body.

* * * * *

UNITED STATES PATENT AND TRADEMARK OFFICE

CERTIFICATE OF CORRECTION

PATENT NO. : 4,784,321

DATED : November 15, 1988

INVENTOR(S) : Philippe Delaplace

It is certified that error appears in the above—identified patent and that said Letters Patent is hereby corrected as shown below:

Claim 8, col. 6, lines 34 and 35, the following should be deleted: ", between 1 and 7 mm"

Claim 11, col. 6, lines 48 and 49, the following should be deleted: ", between 1 and 7 mm"

Signed and Sealed this

Twenty-third Day of May, 1989

*Attest:*

DONALD J. QUIGG

*Attesting Officer*

*Commissioner of Patents and Trademarks*